US010480378B2

(12) United States Patent
Kamo et al.

(10) Patent No.: US 10,480,378 B2
(45) Date of Patent: Nov. 19, 2019

(54) ENGINE EXHAUST STRUCTURE

(71) Applicant: MAZDA MOTOR CORPORATION, Hiroshima (JP)

(72) Inventors: Toshiaki Kamo, Hiroshima (JP); Hirokazu Hasegawa, Higashihiroshima (JP); Haruna Yanagida, Hiroshima (JP); Miki Noguchi, Higashihiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 227 days.

(21) Appl. No.: 15/652,334

(22) Filed: Jul. 18, 2017

(65) Prior Publication Data

US 2018/0030875 A1 Feb. 1, 2018

(30) Foreign Application Priority Data

Jul. 26, 2016 (JP) ..... 2016-146614

(51) Int. Cl.

| | |
|---|---|
| ***F01N 3/28*** | (2006.01) |
| ***F01N 5/04*** | (2006.01) |
| ***F02B 37/00*** | (2006.01) |
| ***F01N 13/18*** | (2010.01) |
| ***F02B 67/10*** | (2006.01) |

(52) U.S. Cl.

CPC ..... *F01N 3/2892* (2013.01); *F01N 5/04* (2013.01); *F01N 13/1872* (2013.01); *F02B 37/00* (2013.01); *F02B 67/10* (2013.01); *F01N 2240/20* (2013.01); *F01N 2470/18* (2013.01); *F01N 2490/00* (2013.01)

(58) Field of Classification Search

CPC ..... F01N 3/2892; F01N 5/04; F01N 13/1872; F01N 2240/20; F01N 2470/18; F01N 2490/00; F02B 37/00; F02B 37/18

USPC ..... 60/602, 605.1

See application file for complete search history.

(56) References Cited

U.S. PATENT DOCUMENTS

| | | | | |
|---|---|---|---|---|
| 4,529,356 A | | 7/1985 | Ciccarone | |
| 4,559,776 A | * | 12/1985 | Arai | F01N 3/28 60/322 |
| 5,934,070 A | * | 8/1999 | Lagelstorfer | F01N 13/10 60/323 |
| 6,438,949 B1 | * | 8/2002 | Nozaki | F01N 13/14 60/320 |

(Continued)

FOREIGN PATENT DOCUMENTS

| | | | | |
|---|---|---|---|---|
| DE | 3120212 A1 | | 12/1982 | |
| DE | 19636662 A1 | * | 3/1997 | F01N 3/28 |

(Continued)

*Primary Examiner* — Thai Ba Trieu

(74) *Attorney, Agent, or Firm* — Studebaker & Brackett PC

(57) ABSTRACT

A exhaust gas purifier includes a case having a flat transverse section including a pair of facing short sides and a pair of facing long sides, and configured to house a catalytic converter, and an inlet cone including a conical portion, and configured to connect an outlet of the turbine to an inlet of the case. The conical portion includes an inclined wall inclined from a mainstream of the exhaust gas to increase the transverse section of a path of the exhaust gas. A recess recessed inward is formed in a portion corresponding to each of the long sides of the inclined wall of the conical portion.

8 Claims, 14 Drawing Sheets

(56) References Cited

U.S. PATENT DOCUMENTS 7,121,325 B2 * 10/2006 Kruger ..... F02M 26/32 60/320
7,132,087 B2 * 11/2006 Craig ..... B01D 53/885 422/176
2011/0283687 A1 * 11/2011 Dobler ..... F01N 13/1805 60/322
2012/0234003 A1 * 9/2012 O'Kane ..... F01N 3/2892 60/605.1
2013/0263593 A1 * 10/2013 Gonzalez Delgado ..... F01N 3/103 60/311
2015/0101329 A1 4/2015 Tiefenbacher et al.
2016/0053661 A1 * 2/2016 Freeman ..... F01N 3/2892 60/301
2016/0053663 A1 * 2/2016 Davison ..... F01N 13/1822 60/301
2016/0069239 A1 * 3/2016 Freeman ..... F01N 3/2066 60/324
2016/0076430 A1 * 3/2016 Freeman ..... F01N 3/2066 60/301
2016/0312689 A1 * 10/2016 Kemmerling ..... F02B 37/18
2017/0211449 A1 * 7/2017 Gockel ..... F01N 3/2892

FOREIGN PATENT DOCUMENTS

EP 1162098 A1 * 12/2001 ..... F01N 3/0814
FR 2856735 A1 * 12/2004 ..... F01N 13/1805
JP S61-110822 U 7/1986
JP 2005096690 A * 4/2005
JP 2006-329031 A 12/2006
JP 2007-285221 A 11/2007
JP 2015-523490 A 8/2015
WO WO-2012110720 A1 * 8/2012 ..... F01N 3/035

* cited by examiner

ENGINE EXHAUST STRUCTURE

CROSS-REFERENCE TO RELATED APPLICATION

This application claims priority to Japanese Patent Application No. 2016-146614 filed on Jul. 26, 2016, the entire disclosure of which is incorporated by reference herein.

BACKGROUND ART

The present disclosure relates to an engine exhaust structure.

Japanese Unexamined Patent Publication No. 2006-329031 describes an exhaust structure for a turbocharged engine. In this exhaust structure, an expanded portion with an increased diameter is provided directly downstream of a turbine. A straightening vane, which straightens a swirl flow discharged from the turbine, is provided inside the expanded portion. An exhaust gas purifier with a circular transverse section is connected downstream of the expanded portion. The exhaust gas purifier houses a catalytic converter. In this exhaust structure, the expanded portion straightens the flow of the exhaust gas, thereby uniformizing the velocity distribution of the exhaust gas passing through the exhaust gas purifier. As a result, catalyst exhibits sufficient purification performance.

If an exhaust gas purifier is connected directly downstream of a turbine, the exhaust gas purifier is close to an engine. In view of the layout inside an engine compartment, a flat exhaust gas purifier is conceivable. In the exhaust gas purifier, for example, a case housing a catalytic converter has a flat transverse section including a pair of facing short sides and a pair of facing long sides. This configuration efficiently places the exhaust gas purifier near the engine in a small engine compartment.

However, in the case where the exhaust gas purifier is connected directly downstream of the turbine, the exhaust gas flowing into the exhaust gas purifier becomes a strong swirl flow at a high turbine speed. If a strong swirl flow flows into a flat exhaust gas purifier, the velocity of exhaust gas is higher on the long sides than on the short sides in the exhaust gas purifier. After various studies, the present inventors found this fact. If the exhaust gas passing through the exhaust gas purifier has a biased velocity distribution, exhaust gas purification performance may deteriorate. An increase in the flow rate of the exhaust gas in a certain portion of the exhaust gas purifier may cause an excessive temperature rise at the certain portion, which leads to a heat damage.

SUMMARY

The present disclosure was made in view of the problems. The present disclosure provides an engine exhaust structure including a flat exhaust gas purifier connected directly downstream of a turbine to reduce a biased velocity distribution of exhaust gas flowing into a case of the exhaust gas purifier.

The present disclosure relates to an engine exhaust structure. The engine exhaust structure includes a turbine of a turbocharger provided for an exhaust pipe of an engine, and rotated by energy of exhaust gas of the engine; and an exhaust gas purifier connected directly downstream of the turbine, and configured to purify the exhaust gas. The exhaust gas purifier includes a case having a flat transverse section including a pair of facing short sides and a pair of facing long sides, and configured to house a catalytic converter, and an inlet cone including a conical portion, and configured to connect an outlet of the turbine to an inlet of the case, the conical portion including an inclined wall inclined from a mainstream of the exhaust gas to increase the transverse section of a path of the exhaust gas.

A recess recessed inward is formed in a portion corresponding to each of the long sides of the inclined wall of the conical portion.

In this configuration, the exhaust gas purifier is connected directly downstream of the turbine. The exhaust gas purifier may be connected directly to the outlet of the turbine. This configuration raises the temperature of the exhaust gas flowing into the exhaust gas purifier, which is advantageous in activating the exhaust gas purifier earlier. In addition, since the engine has a high thermal efficiency, in an engine discharging low-temperature exhaust gas, the connection of the exhaust gas purifier directly downstream of the turbine raises the temperature of the exhaust gas flowing into the exhaust gas purifier. This is advantageous in maintaining the exhaust gas purifier in an active state.

The exhaust gas purifier connected directly downstream of the turbine is placed near the engine. The exhaust gas purifier includes the case with a flat transverse section. The flat case enables efficient placement of the exhaust gas purifier near the engine in a small engine compartment.

The exhaust gas purifier includes the inlet cone. The inlet cone includes the conical portion including the inclined wall inclined from the mainstream of the exhaust gas. The exhaust gas from the turbine flows into the case housing the catalytic converter via the inlet cone, while diffusing in a direction orthogonal to the mainstream of the exhaust gas.

At a high turbine speed, the exhaust gas flowing into the case swirls strongly. Due to the centrifugal force, the exhaust gas flows toward the peripheral area in the conical portion. In the flat case, long side portions are closer to the inlet of the inlet cone than short side portions are. When the exhaust gas swirls strongly, the velocity of the exhaust gas is higher at the long side portions than at the short side portions in the case of the exhaust gas purifier.

In the configuration described above, the recess recessed inward is formed in a portion corresponding to each of the long sides of the inclined wall of the conical portion. In the inlet cone, the exhaust gas flowing toward the peripheral area due to the centrifugal force is restricted by the recess. The exhaust gas is oriented by the recess from the long sides to the short sides. This reduces a biased velocity distribution of the exhaust gas flowing into the flat case, when the exhaust gas swirls strongly. This results in a uniform velocity distribution of the exhaust gas passing through the exhaust gas purifier, thereby maintaining high exhaust gas purification performance. This also reduces a local increase in the flow rate of the exhaust gas at the long side portions of the flat case. As a result, heat damages at the long side portions are reduced.

The recess may include a first wall expanding along the mainstream of the exhaust gas and along the long sides, and a second wall continuous with the first wall, and expanding outward from the first wall along the long sides.

With this configuration, a relatively strong swirl flow orients the exhaust gas flowing toward the peripheral area along the first wall, which expands along the long sides in the inlet cone. Since the exhaust gas flows from the long sides to the short sides, the velocity distribution of the exhaust gas flowing into the flat case becomes uniform.

An expanded portion may be provided between the outlet of the turbine and an inlet of the inlet cone, and a transverse section of the path of the exhaust gas may gradually increase in the expanded portion.

The velocity of the exhaust gas decreases as the exhaust gas passes through the expanded portion. Thus, when passing through the inlet cone, the exhaust gas tends to diffuse in the direction orthogonal to the mainstream. This reduces a biased velocity distribution of the exhaust gas flowing into the case of the exhaust gas purifier.

A position of the outlet of the turbine connected to the conical portion may be shifted toward one of the short sides in a direction, in which the short sides face each other. A first side and a second side may be provided in a direction in which the long sides face each other, with the inlet of the conical portion interposed therebetween. A first recess may be formed in a portion of one of the long sides, through which the exhaust gas from the inlet of the conical portion passes in a direction, in which the exhaust gas swirls, to reach the one of the short sides. A second recess may be formed in a portion of the other one of the long sides, through which the exhaust gas from the inlet of the conical portion passes in the direction, in which the exhaust gas swirls, to reach the other one of the short sides. The second recess may be larger than the first recess.

A large recess including a deep and/or long recess is more advantageous in restricting the exhaust gas flowing toward the peripheral area and orienting the exhaust gas from the long sides to the short sides.

When the position of the exhaust pipe connected to the conical portion is shifted toward one of the short sides in a direction in which the short sides face each other, the second recess in a larger size strictly restricts the exhaust gas flowing toward the peripheral area, and orients the exhaust gas to the other short side, which is farther from the inlet of the conical portion.

On the other hand, the first recess in a smaller size restricts the exhaust gas flowing toward the peripheral area less strictly, and orients the exhaust gas toward the other short side, which is closer to the inlet of the conical portion.

This difference in size between the first and second recesses when the position of the outlet of the turbine connected to the conical portion is shifted from the center makes the velocity distribution flowing into the case uniform.

The recess may include an upstream recess located upstream in a direction in which the exhaust gas swirls along the long sides, and a downstream recess located downstream in the direction in which the exhaust gas swirls along the long sides. The downstream recess may be recessed more deeply than the upstream recess.

Since the downstream recess is recessed more deeply than the upstream recess, the exhaust gas is restricted strictly, and orients the exhaust gas toward the short sides. A combination of the upstream and downstream recesses improves the controllability of the flow of the exhaust gas in the conical portion. This is advantageous in making the velocity distribution of the exhaust gas flowing into the case more uniform.

An engine compartment including the engine may include the exhaust gas purifier and a second exhaust gas purifier connected downstream of the exhaust gas purifier.

The second exhaust gas purifier may house a catalytic converter. The second exhaust gas purifier may house a filter (e.g., a diesel particulate filter).

The second exhaust gas purifier in the engine compartment provides an underfloor space. This increases a cabin space. Both the exhaust gas purifiers are placed in the engine compartment, which is advantageous in controlling the temperatures of the exhaust gas purifiers.

The engine may be mounted vertically. The case of the exhaust gas purifier may have a vertically long flat transverse section. The exhaust gas purifier may be placed on a side of the engine. The engine and the exhaust gas purifier are surrounded by partitions and encapsulated.

This is advantageous in maintaining the temperatures of the engine and the exhaust gas purifier. A high efficiency engine is advantageous in maintaining high temperatures of the engine and the exhaust gas purifier in an idle stop or an idle operation. The engine is covered, which is advantageous in reducing noise during the operation of the engine.

The exhaust gas purifier with a vertically long flat shape requires a small space on a side of a vertically mounted engine. This increases the space efficiency in the engine compartment. In addition, the exhaust gas purifier has a small size but a larger volume, thereby reducing the back pressure of the engine.

The turbine may be placed above an exhaust manifold of the engine. The exhaust gas purifier may be placed near a top of the engine. A heat shielding wall covering the engine and the exhaust gas purifier is placed above the exhaust gas purifier.

With this configuration, the exhaust gas flows into the turbine at high energy, and the turbocharged engine is provided in a small size in the vehicle width direction. The heat shielding wall covers the engine, and the top of the exhaust gas purifier near the top of the engine, which is advantageous in maintaining the temperatures of the engine and the exhaust gas purifier.

DETAILED DESCRIPTION

Figure 1:
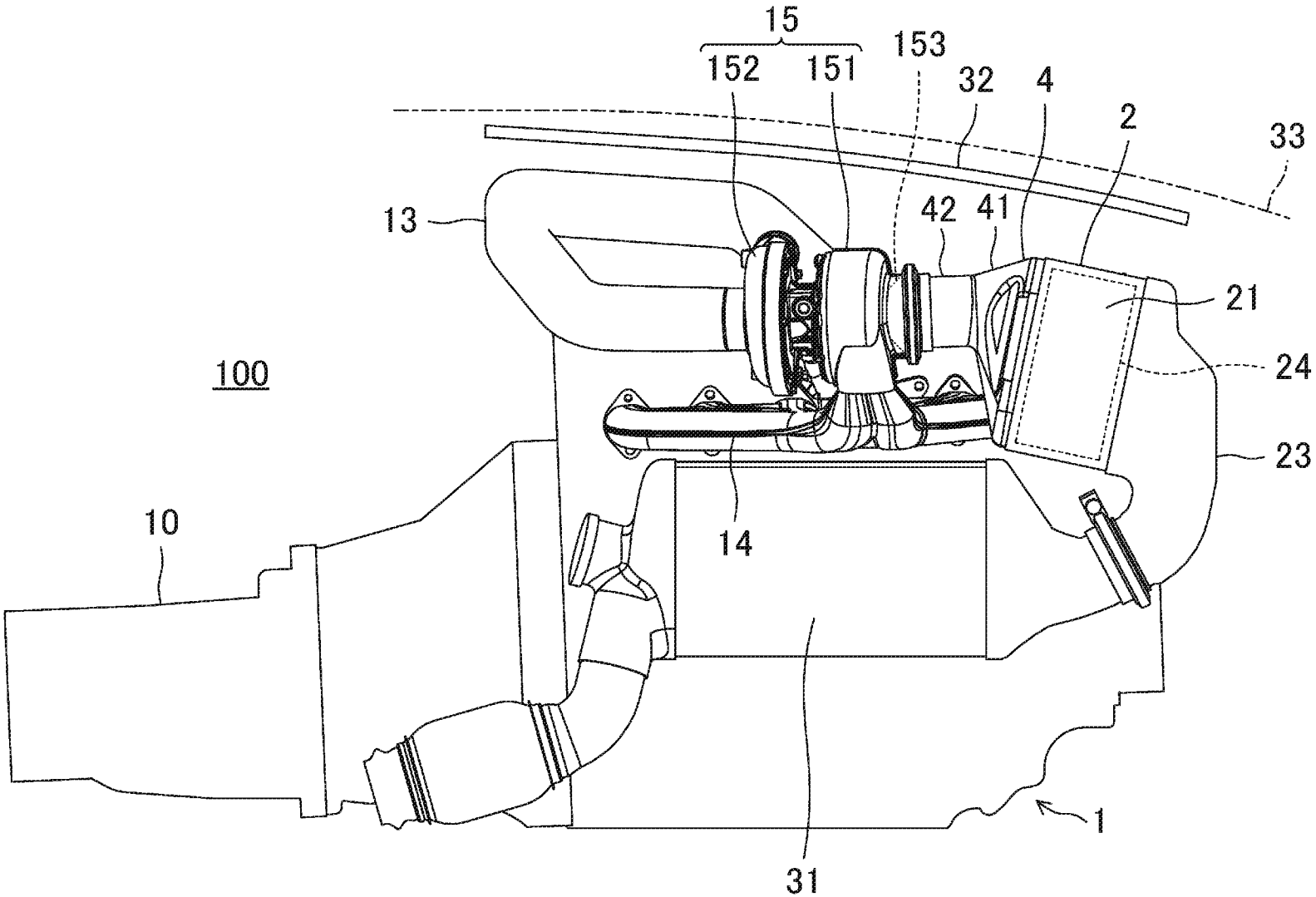
FIG. 1 is a side view illustrating a structure of an engine employing an exhaust structure.
Figure 2:
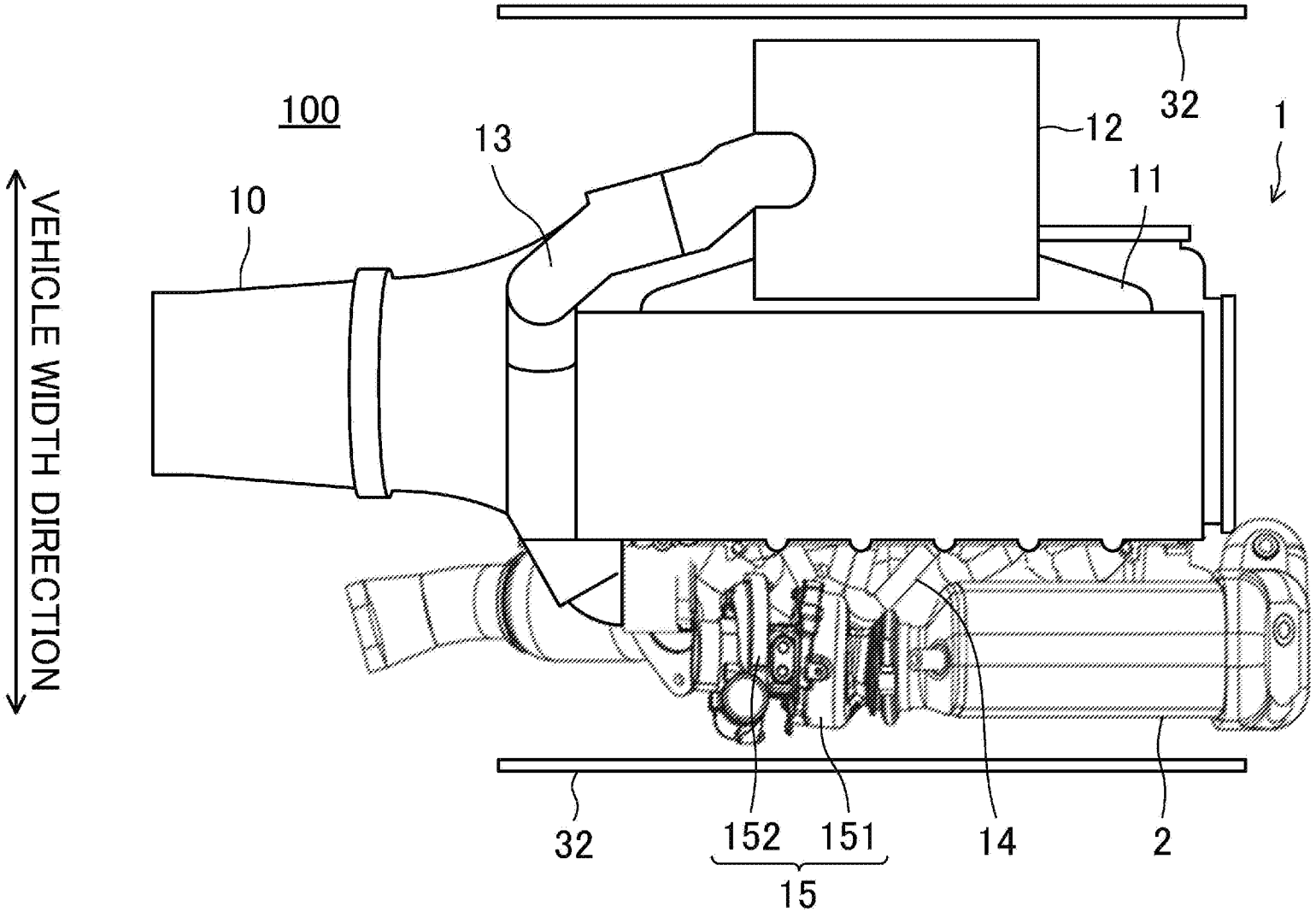
FIG. 2 is a plan view illustrating the structure of the engine.

An exhaust structure of an engine disclosed herein will now be described with reference to the drawings. The following description is illustrative only. FIGS. 1 and 2 illustrate a structure of an engine employing an exhaust structure disclosed herein. An engine 1 mounted in a motor vehicle is a multi-cylinder internal combustion engine. Specifically, the engine 1 shown in these figures is an in-line four diesel engine. However, the engine 1 is not limited to a diesel engine. The engine 1 may be a so-called gasoline engine. The engine 1 is mounted longitudinally in an engine compartment 100. That is, the right of FIGS. 1 and 2 corresponds to the front of a vehicle. A transmission 10 is attached to the rear end of the engine 1.

An intake manifold 11 is attached on the left of the engine 1, which corresponds to the left as viewed forward from the rear of the vehicle, and the upper part of FIG. 2. An intercooler 12 is placed above the intake manifold 11. Although not shown specifically, an intake pipe 13 is connected to the intake manifold 11 via the intercooler 12.

An exhaust manifold 14 is as a part of an exhaust pipe attached on the right of the engine 1, which corresponds to the right as viewed forward from the rear, and the lower part of FIG. 2. As shown in FIGS. 1 and 2, a turbocharger 15 is placed above the exhaust manifold 14. The turbocharger 15 is placed near the upper end of the engine 1. The rotation axis of the turbocharger 15 extends in the vehicle longitudinal direction. The turbocharger 15 is placed such that a turbine 151 is located in front of a compressor 152. The exhaust manifold 14 is connected to the turbine 151. The intake pipe 13 is connected to the compressor 152.

The exhaust gas purifier 2 is placed in front of the turbine 151. The exhaust gas purifier 2 is connected directly downstream of the turbine 151. The exhaust gas purifier 2 includes an oxidation catalytic converter 24. The exhaust gas purifier 2 is placed at an upper front end of the right of the engine 1. The exhaust gas purifier 2 has a flat transverse section, which is long in the vertical direction and short in the vehicle width direction. A specific structure of the exhaust gas purifier 2 will be described later.

A second exhaust gas purifier 31 is connected downstream of the exhaust gas purifier 2. The second exhaust gas purifier 31 is a diesel particulate filter (DPF). On the right of the engine 1, the second exhaust gas purifier 31 is located below the exhaust manifold 14. The second exhaust gas purifier 31 has a flat transverse section, which is long in the vertical direction and short in the vehicle width direction. The second exhaust gas purifier 31 extends in the vehicle longitudinal direction. Although not shown, a space is provided on the bottom of the vehicle by the second exhaust gas purifier 31 being a DPF placed inside the engine compartment 100. This increases a cabin space. In addition, the design flexibility of the cabin space increases to optimize the driving position of the driver.

As described above, each of the exhaust gas purifiers 2 and 31 has a flat transverse section. The exhaust gas purifiers 2 and 31 are located on the right of the engine 1. These exhaust gas purifiers 2 and 31 as well as the engine 1 are in a small size in the vehicle width direction. This increases the space efficiency in the small engine compartment 100.

In the flat shape, the exhaust gas purifier 2 has a small size but a large volume. This configuration reduces the back pressure of the engine 1, thereby increasing the fuel efficiency.

In the engine compartment 100, these exhaust gas purifiers 2 and 31 as well as the engine 1 are surrounded by a heat shielding wall 32. Specifically, the heat shielding wall 32 extends from the left to the right of the engine 1 through the upper part of the engine 1. In FIG. 1, reference numeral 33 denotes an engine hood (i.e., a bonnet). The heat shielding wall 32 extends along the engine hood 33 between the engine 1 and the engine hood 33. The engine 1, the exhaust gas purifier 2 and the second exhaust gas purifier 31 are encapsulated by the heat shielding wall 32.

The thermal efficiency of this engine 1 is significantly high. That is, the engine 1 has low cooling loss and exhaust loss. Thus, the engine 1 and the exhaust gas have a relatively low temperature. In order to maintain each of the engine 1 and the exhaust gas purifier 2 at a high temperature during idle stop and idle operation, the heat shielding wall 32 reduces heat radiation from the engine 1 and the exhaust gas purifier 2. The heat shielding wall 32 maintains each of the engine 1 and the exhaust gas purifier 2 at a high temperature.

Both the exhaust gas purifier 2 and the second exhaust gas purifier 31 are placed inside the engine compartment 100, thereby raising the temperature of exhaust gas flowing into these exhaust gas purifiers 2 and 31. This is advantageous in activating the exhaust gas purifier 2, and controlling the temperatures of the exhaust gas purifier 2 and the second exhaust gas purifier 31.

In addition, encapsulation of the engine 1 is advantageous in reducing noise during the operation of the engine 1.

Figure 3:
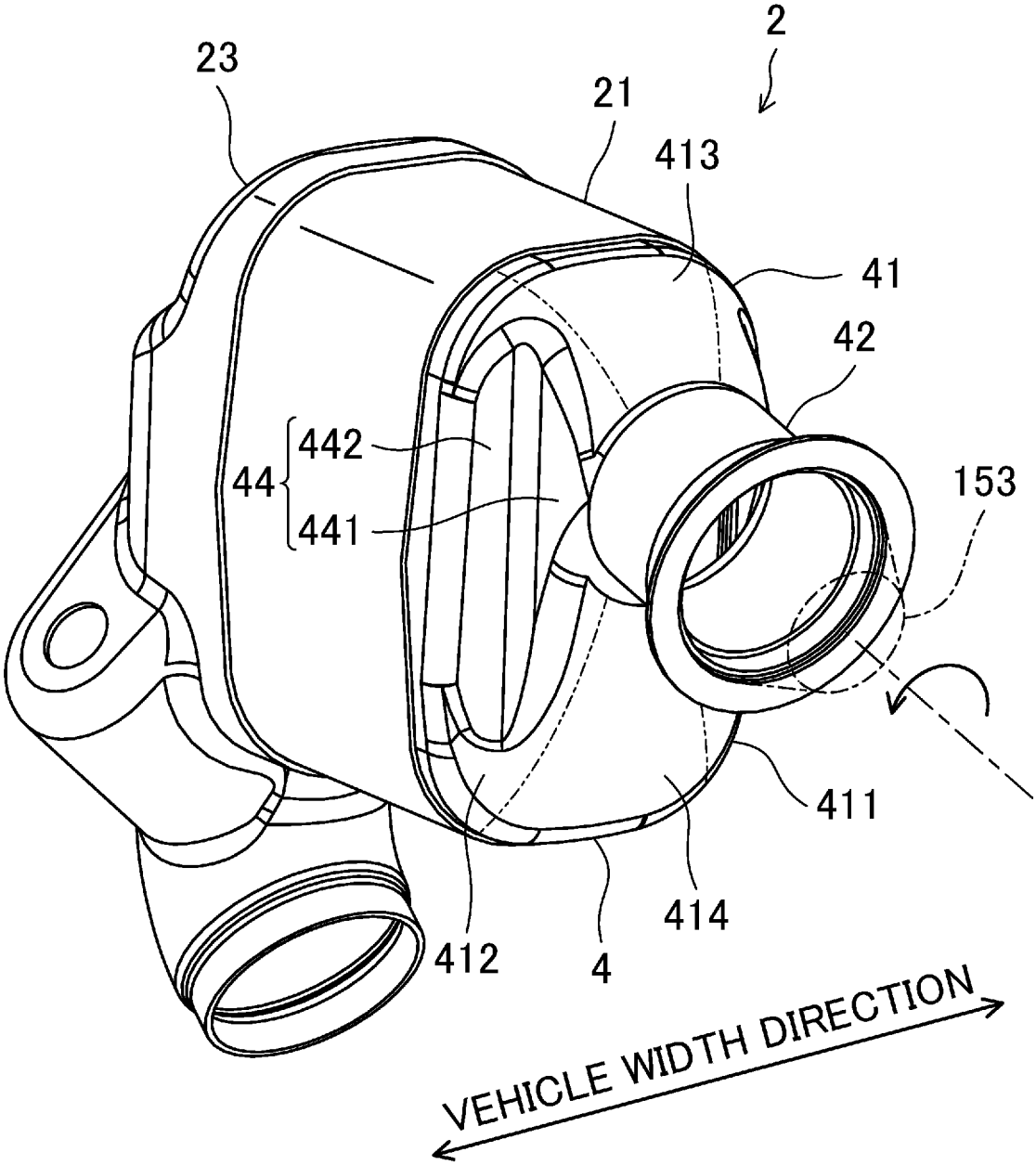
FIG. 3 is a perspective view of an exhaust gas purifier as viewed from the left rear.
Figure 4:
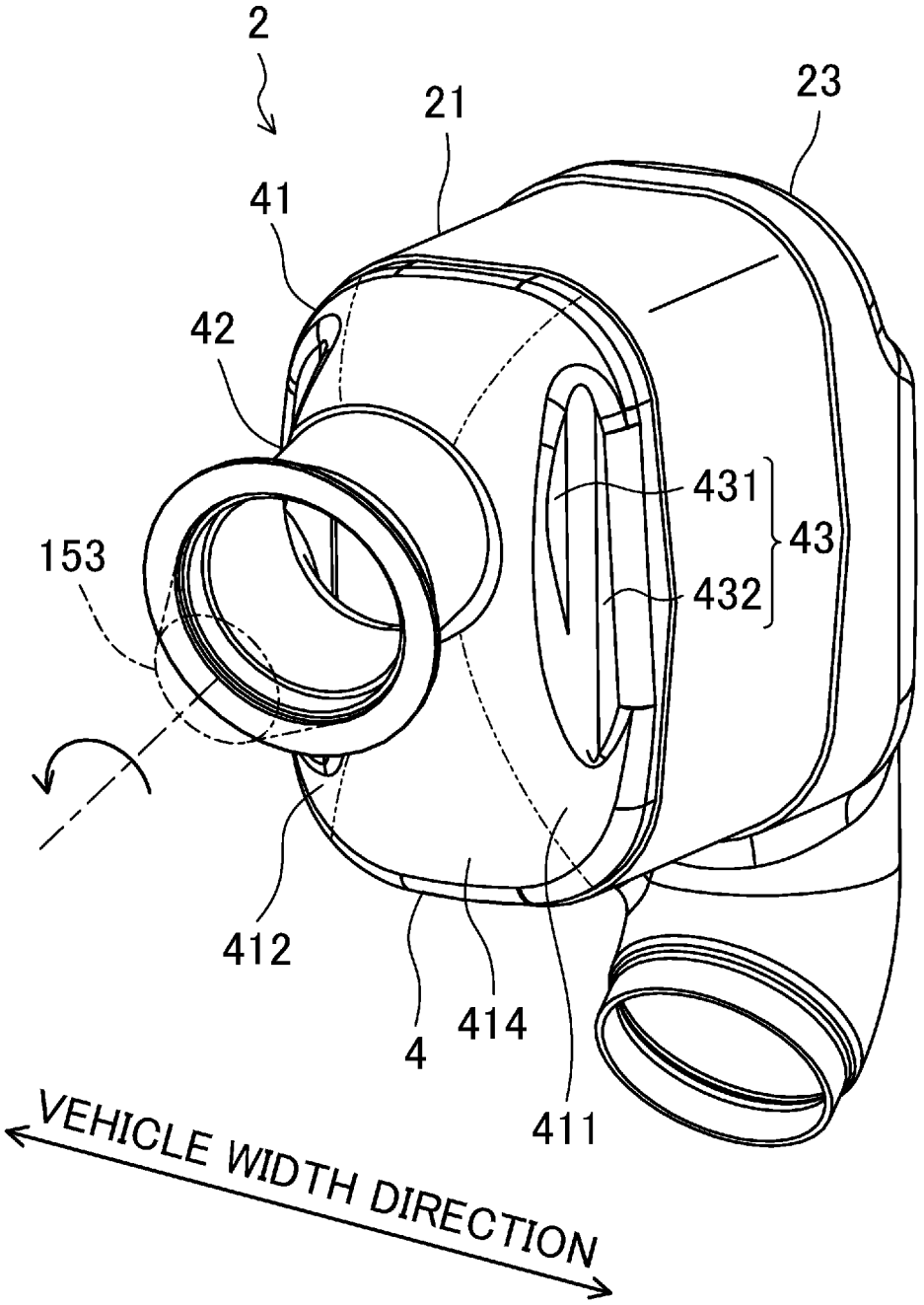
FIG. 4 is a perspective view of the exhaust gas purifier as viewed from the right rear.
Figure 5:
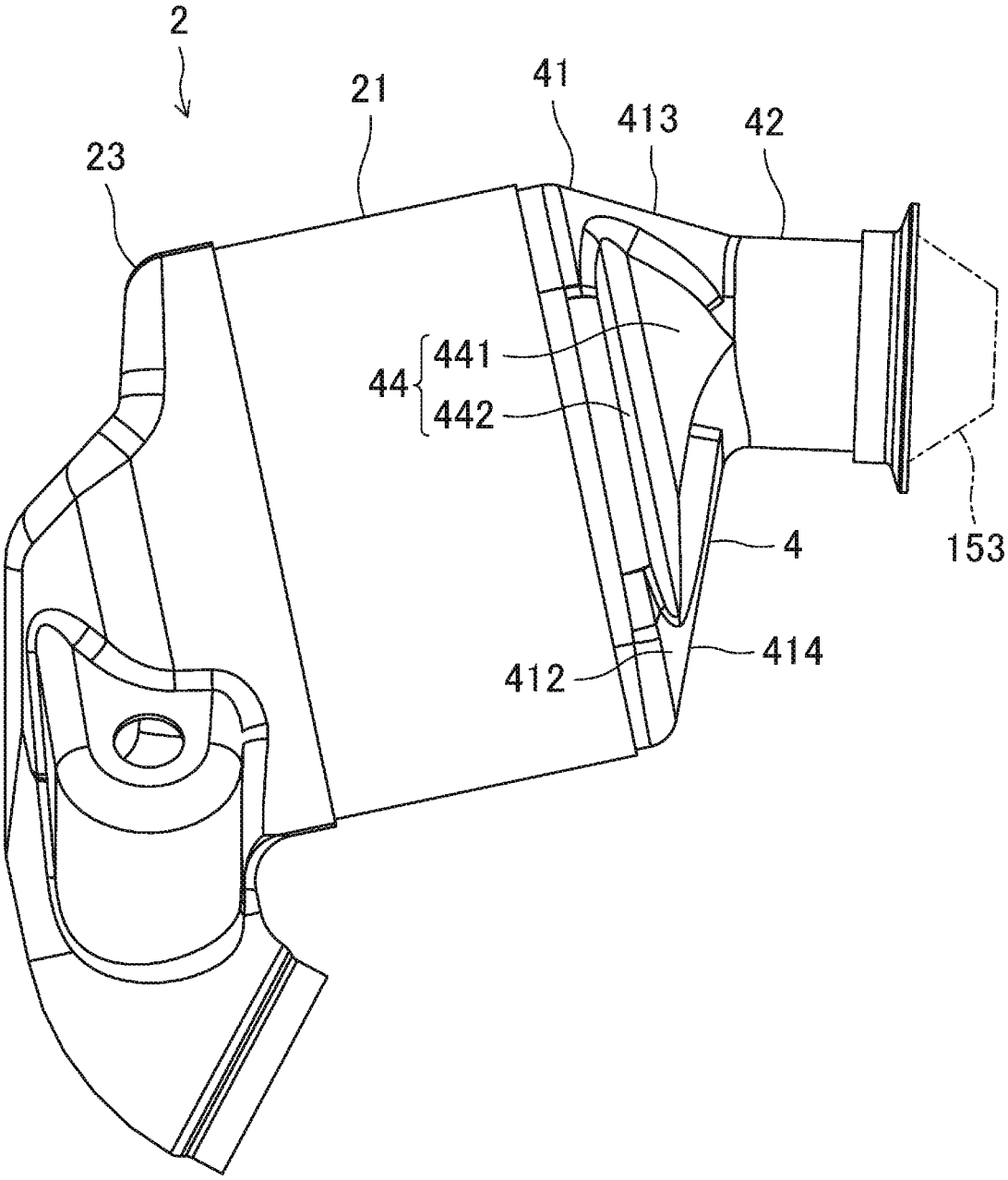
FIG. 5 is a left side view of the exhaust gas purifier.
Figure 6:
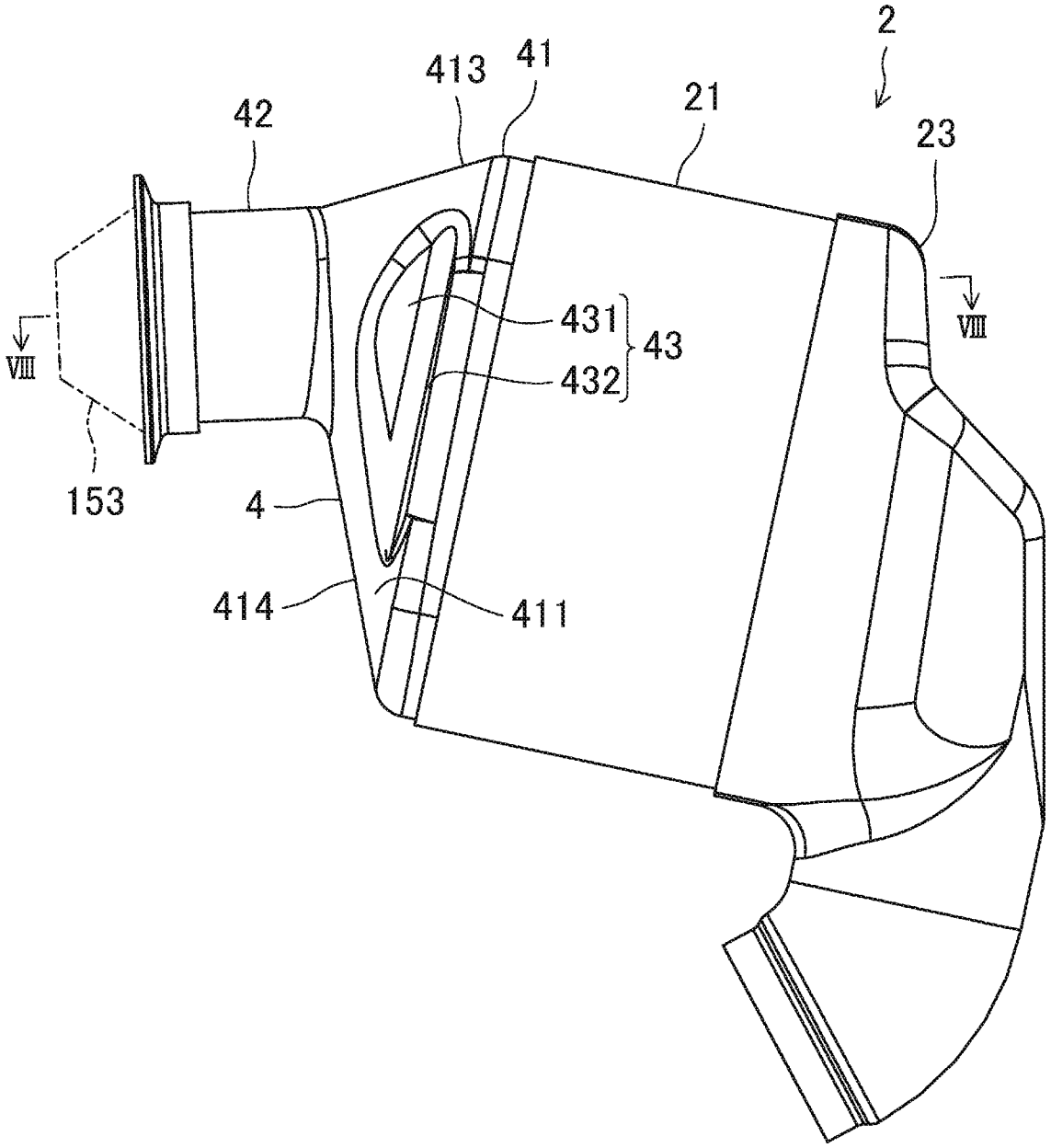
FIG. 6 is a right side view of the exhaust gas purifier.
Figure 7:
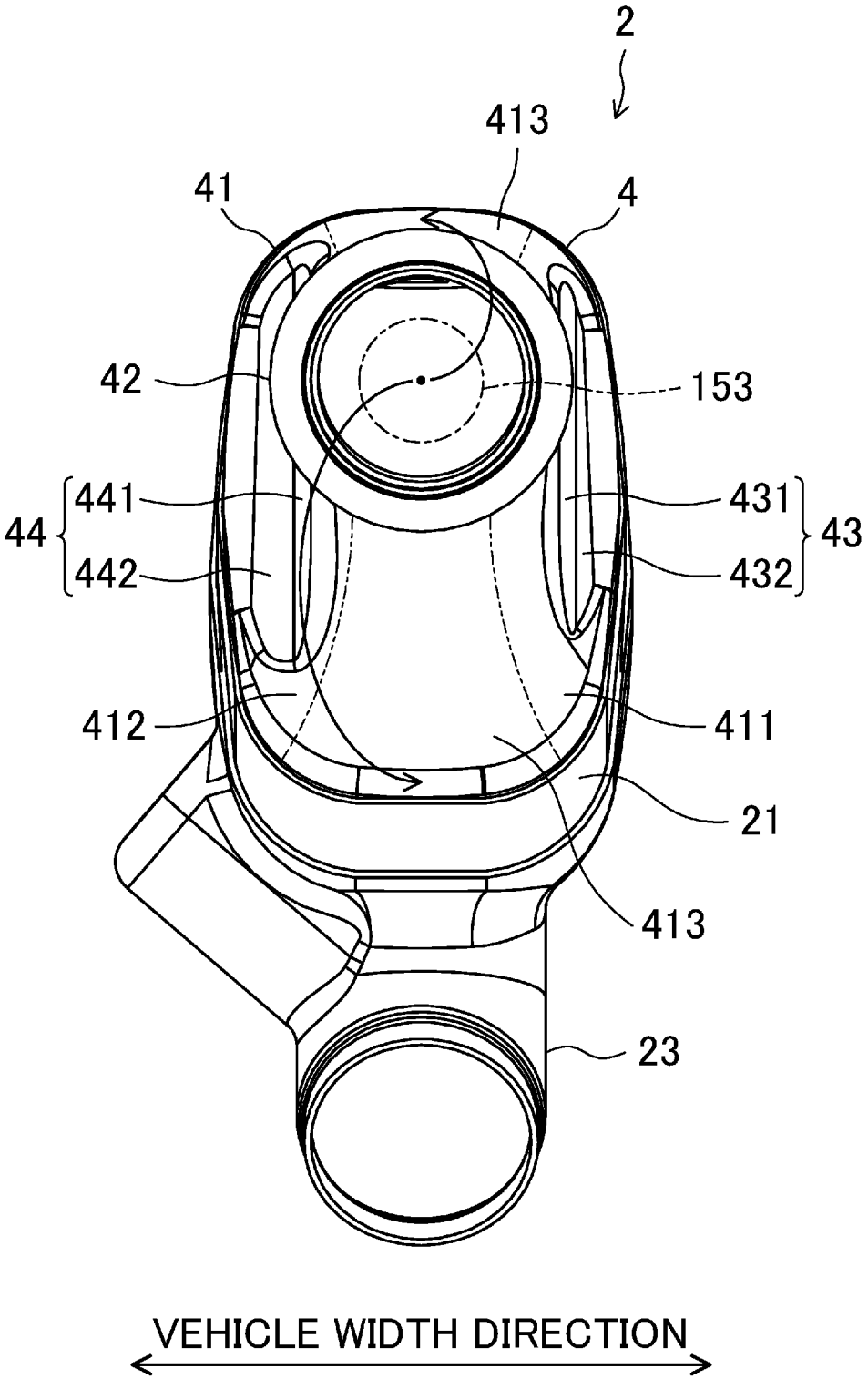
FIG. 7 is a front view of the exhaust gas purifier.
Figure 8:
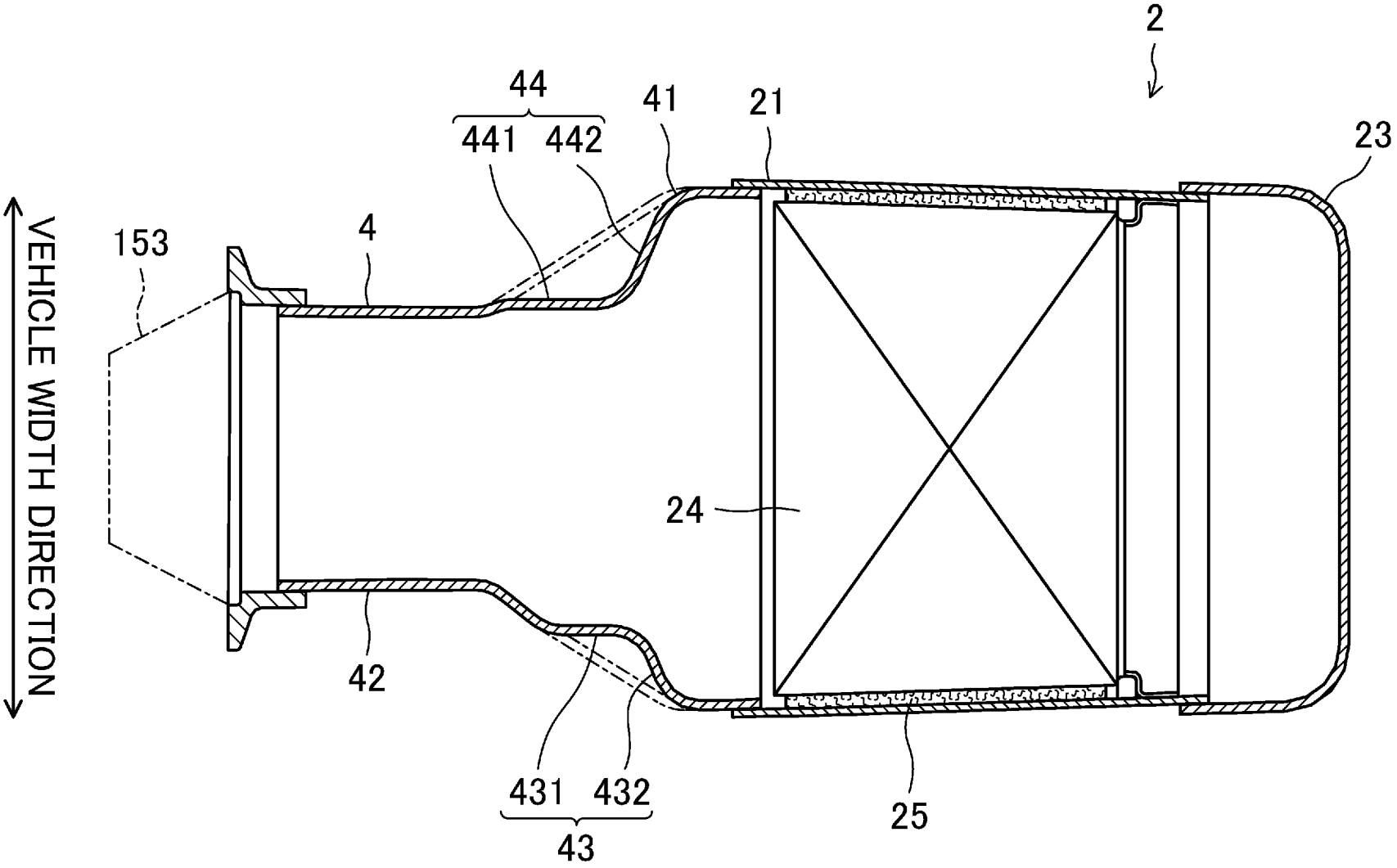
FIG. 8 is an end view taken along the line VIII-VIII of FIG. 6.

FIGS. 3 to 8 illustrate a specific structure of the exhaust gas purifier 2. Specifically, FIG. 3 is a left rear perspective view of the exhaust gas purifier 2. FIG. 4 is a right rear perspective view of the exhaust gas purifier 2. FIG. 5 is a left side view of the exhaust gas purifier 2. FIG. 6 is a right side view of the exhaust gas purifier 2. FIG. 7 is a front view of the exhaust gas purifier 2. FIG. 8 is a cross-sectional view taken along the line VIII-VIII of FIG. 6.

The exhaust gas purifier 2 includes a case 21, an inlet cone 4, and an outlet 23. The case 21 houses the catalytic converter 24. The inlet cone 4 is attached to the upstream end of the case 21. The outlet 23 is attached to the downstream end of the case 21. The outlet 23 extends vertically to connect the case 21 to the second exhaust gas purifier 31, which is located below the exhaust gas purifier 2 (see also FIG. 1). The outlet 23 inverts the mainstream of the exhaust gas from the direction from the rear to the front of the vehicle to the direction from the front to the rear of the vehicle.

The case 21 has a cylindrical shape with open ends. The upstream (left in FIG. 8) opening of the case 21 functions as an inlet of the case 21. The downstream (right in FIG. 8) opening of the case 21 functions as an outlet of the case 21. The shaft of the case 21 extends almost horizontally, specifically, is inclined slightly downward toward the front of the vehicle. The case 21 has a substantially rectangular transverse section with a pair of short sides facing vertically, and a pair of long sides facing laterally (in the vehicle width direction). As shown in FIG. 8, the case 21 houses the catalytic converter 24. A holding mat 25 holding the catalytic converter 24 is provided between the catalytic converter 24 and the inner peripheral surface of the case 21. The holding mat 25 is made of a fiber material.

The inlet cone 4 includes a conical portion 41 and a straight portion 42. The conical portion 41 is attached to the inlet of the case 21. The straight portion 42 connects the conical portion 41 and the outlet of the turbine.

The straight portion 42 has a cylindrical shape with open ends. The shaft of the straight portion 42 extends almost horizontally to agree with the rotation axis of the turbine 151 extending substantially horizontally. The straight portion 42 has a much smaller transverse sectional area than the case 21. The shaft of the straight portion 42 is shifted above the shaft of the case 21. As a result, the upper end of the case 21 is located in a relatively low vertical position as shown in FIG. 1. As described above, the shaft of the case 21 is inclined downward toward the front of the vehicle. As virtually shown in FIG. 1, the exhaust gas purifier 2 is placed below the engine hood 33 and near the front end of the engine 1 in the engine compartment 100. The engine hood 33 is inclined downward toward the front.

An expanded nozzle 153 as the expanded portion is provided at the outlet of the turbine 151, to which the straight portion 42 is connected. The expanded nozzle 153 is represented by the broken line in FIG. 1, and the dashed line in FIGS. 3 to 8. The inner peripheral surface of the expanded nozzle 153 segments the path of the exhaust gas, and is inclined with respect to the vehicle longitudinal direction so that the transverse section of the path gradually increases.

The velocity of the exhaust gas decreases as exhaust gas passes through the expanded nozzle 153 with an increased cross-section. Thus, when the exhaust gas passes through the inlet cone 4, the exhaust gas tends to diffuse in the direction orthogonal to the mainstream. This leads to a uniform velocity distribution of the exhaust gas flowing into the case 21 of the exhaust gas purifier 2, thereby improving the exhaust gas purification performance. In addition, the uniform velocity distribution reduces the resistance of the exhaust gas, which is advantageous in improving the fuel efficiency.

The conical portion 41 connects the straight portion 42 with a small transverse sectional area to the case 21 with a large transverse sectional area. The conical portion 41 includes inclined walls, which are inclined from the mainstream of the exhaust gas to increase the transverse section of the path of the exhaust gas. The conical portion 41 includes four inclined walls 411, 412, 413, and 414 to connect the straight portion 42 with a circular transverse section to the case 21 with a flat transverse section. The four inclined walls include two inclined walls 411 and 412 corresponding to the pair of long sides of the case 21, and two inclined walls 413 and 414 corresponding to the pair of short sides of the case 21. In FIGS. 3, 4, and 7, the boundaries among the four inclined walls 411, 412, 413, and 414 are virtually indicated by a two-dot chain. The two inclined walls corresponding to the pair of long sides are a right inclined wall 411 and a left inclined wall 412. The two inclined walls corresponding to the pair of short sides are an upper inclined wall 413 and a lower inclined wall 414. The right inclined wall 411 has the same shape as the left inclined wall 412. As described above, the straight portion 42 is shifted upward from the center of the case 21. In other words, the position of the outlet of the turbine 151 connected to the conical portion 41 is shifted upward. Thus, the upper inclined wall 413 has a different shape from the lower inclined wall 414.

The right and left inclined walls 411 and 412 of the conical portion 41 have recesses 43 and 44, respectively. Each of the recesses 43 and 44 is recessed toward the inside of the conical portion 41. The recess 43 includes first walls 431 and a second wall 432. The recess 44 includes first walls 441 and a second wall 442. The first walls 431 and 441 expands along the mainstream of the exhaust gas (in the vehicle longitudinal direction) and along the long sides. The second walls 432 and 442 are continuous with the first walls 431 and 441, and expand outward from the first walls 431 and 441 along the long sides, respectively.

The recess of the right inclined wall 411 (i.e., the first recess 43) has a different size from the recess of the left inclined wall 412 (i.e., the second recess 44). Specifically, the second recess 44 of the left inclined wall 412 is larger than the first recess 43 of the right inclined wall 411. As shown in FIG. 8, a large recess means herein that the recess 43 or 44 has a great inward depth. Due to the deeper recess, the first wall 441 of the second recess 44 is longer than the first wall 431 of the first recess 43, and the second wall 442 of the second recess 44 is longer than the second wall 432 of the first recess 43.

As indicated by the arrow in FIGS. 3 and 4, the swirl flow from the turbine 151 swirls counterclockwise when the exhaust gas purifier 2 is viewed from its front. In FIG. 7, where the "right" and "left" represent the right and left of the inlet of the conical portion 41, the exhaust gas coming out of the inlet of the conical portion 41 passes through the right long side along the swirling direction to reach the upper short side. The exhaust gas coming out of the inlet of the conical portion 41 passes through the left long side along the swirling direction to reach the lower short side. Thus, in this configuration of the exhaust gas purifier 2, the second recess 44, through which the exhaust gas coming out of the inlet of the conical portion 41 passes along the swirling direction to reach the lower short side is larger than the first recess 43, through which the exhaust gas passes to reach the upper short side.

The exhaust gas purifier 2 is connected directly downstream of the outlet of the turbine 151. At a high speed of the turbine 151, the exhaust gas swirls strongly to flow into the case 21 via the inlet cone 4. Strong swirling causes centrifugal force, which orients the exhaust gas outward. In the case 21 with a flat transverse section, long side portions are closer to the inlet of the inlet cone 4 than short side portions are. Thus, the flow rate of the exhaust gas at the long side portions would be higher than that at the short side portions.

However, in the exhaust gas purifier 2 configured as above, the first and second inward recesses 43 and 44 are formed in the right and left inclined walls 411 and 412, which correspond to the pair of long sides. Inside the inlet cone 4, the exhaust gas flow flowing toward the peripheral area is restricted by the first and second recesses 43 and 44. The exhaust gas flows along first walls 431 and 441 of the first and second recesses 43 and 44. The exhaust gas flow is changed to the direction from the long sides to the short sides. This reduces a biased velocity distribution of the exhaust gas flowing into the case 21 with a flat transverse section, when the exhaust gas swirls strongly. As a result, the exhaust gas purifier 2 maintains high purification performance.

In addition, the first and second recesses 43 and 44 reduce an increase in the flow rate of the exhaust gas at the long side portions of the case 21 with the flat transverse section. This leads to reduction in heat damages (e.g., wind erosion of the holding mat 25, which holds the catalytic converter 24) at the long side portions. As a result, the reliability of the exhaust gas purifier 2 improves.

In the configuration described above, the straight portion 42 of the inlet cone 4 is shifted upward from the center of the conical portion 41 to be connected to the conical portion 41. In accordance with the shift direction and the swirling direction of the exhaust gas, the second recess 44 of the left inclined wall 412 is formed larger. When the exhaust gas swirls strongly, the second recess 44 strictly restrict the exhaust gas flowing toward the peripheral area, thereby orienting the exhaust gas toward the lower short side, which is farther from the inlet of the inlet cone 4 (see the arrow in FIG. 7).

On the other hand, the small first recess 43 of the right inclined wall 411 restrict the flowing exhaust gas less strictly, thereby orienting the exhaust gas toward the upper short side, which is closer to the inlet of the inlet cone 4.

This leads to a uniform velocity distribution of the exhaust gas flowing into the case 21 even in the exhaust gas purifier 2, in which the straight portion 42 is connected to the conical portion 41 in a shifted position from the center.

Example

Figure 9:
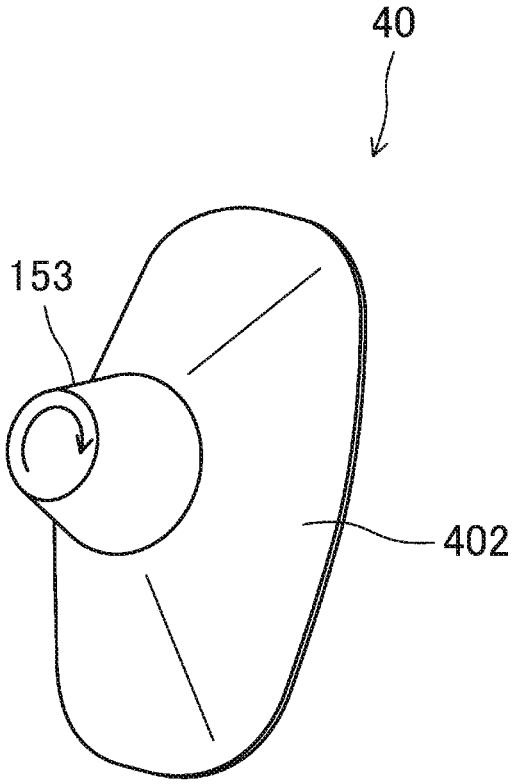
FIG. 9 is a perspective view illustrating a shape of a modeled inlet cone.

A simulation related to the shape of the inlet cone will now be described with reference to the drawings. This simulation uses a modeled inlet cone 40 as shown in FIG. 9. As the modeled inlet cone 40, the straight portion is not shown and only a conical portion 402 is shown. The expanded nozzle 153 at the outlet of the turbine 151 is directly connected to the conical portion 402. The expanded nozzle 153 is connected to the center of the conical portion 402. The inlet cone 40 in FIG. 9 includes no recess. This example simulates the exhaust gas flow in the expanded nozzle 153 and the conical portion 402. In this simulation, as indicated by the arrow in FIG. 9, the swirl flow discharged from the turbine 151 swirls clockwise when the exhaust gas purifier 2 is viewed from its front. This is opposite to the embodiment described above.

Figure 10:
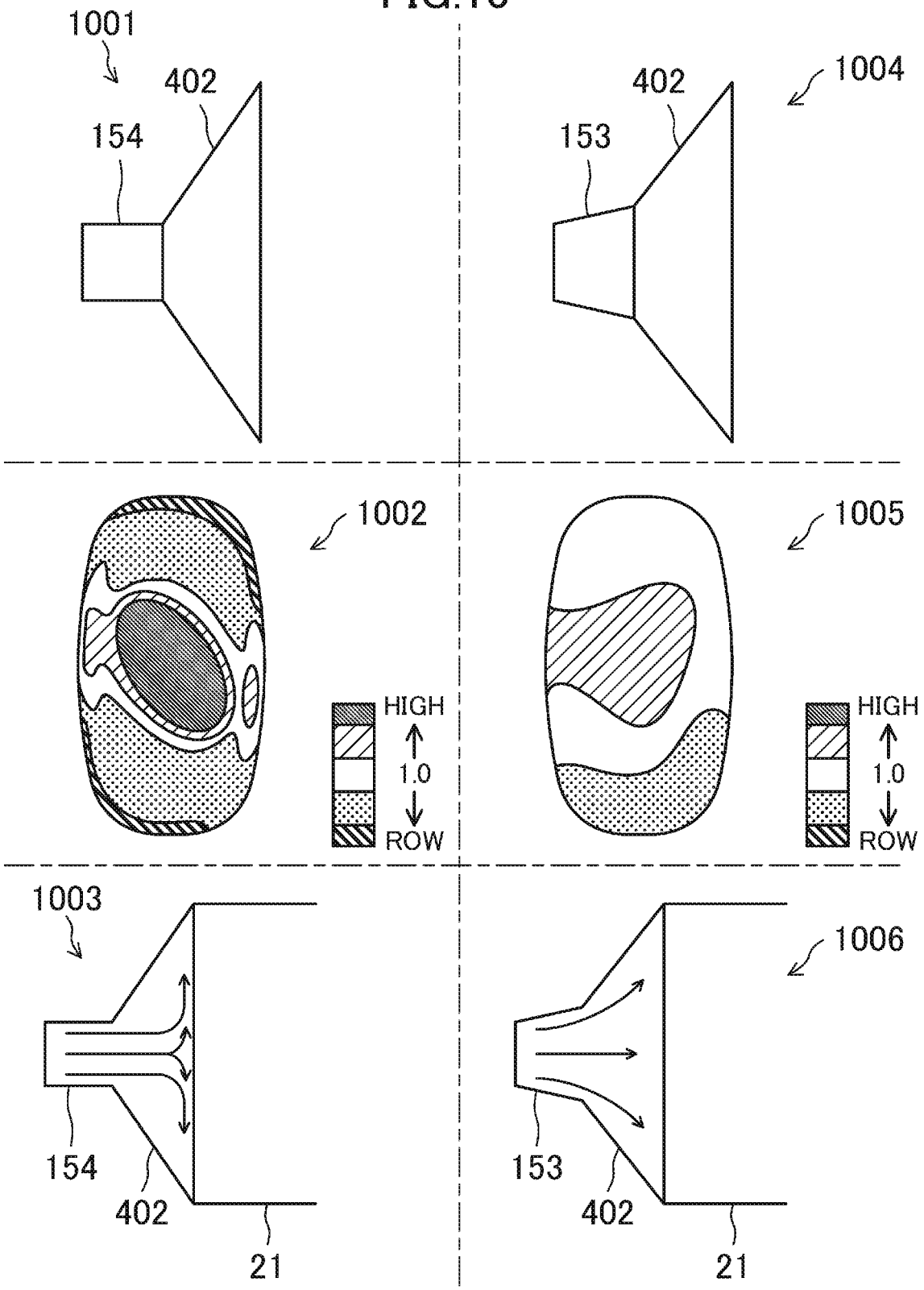
FIG. 10 illustrates the comparison in the exhaust gas flow inside an inlet cone between a straight nozzle and an expanded nozzle, when the exhaust gas swirls weakly.
Figure 11:
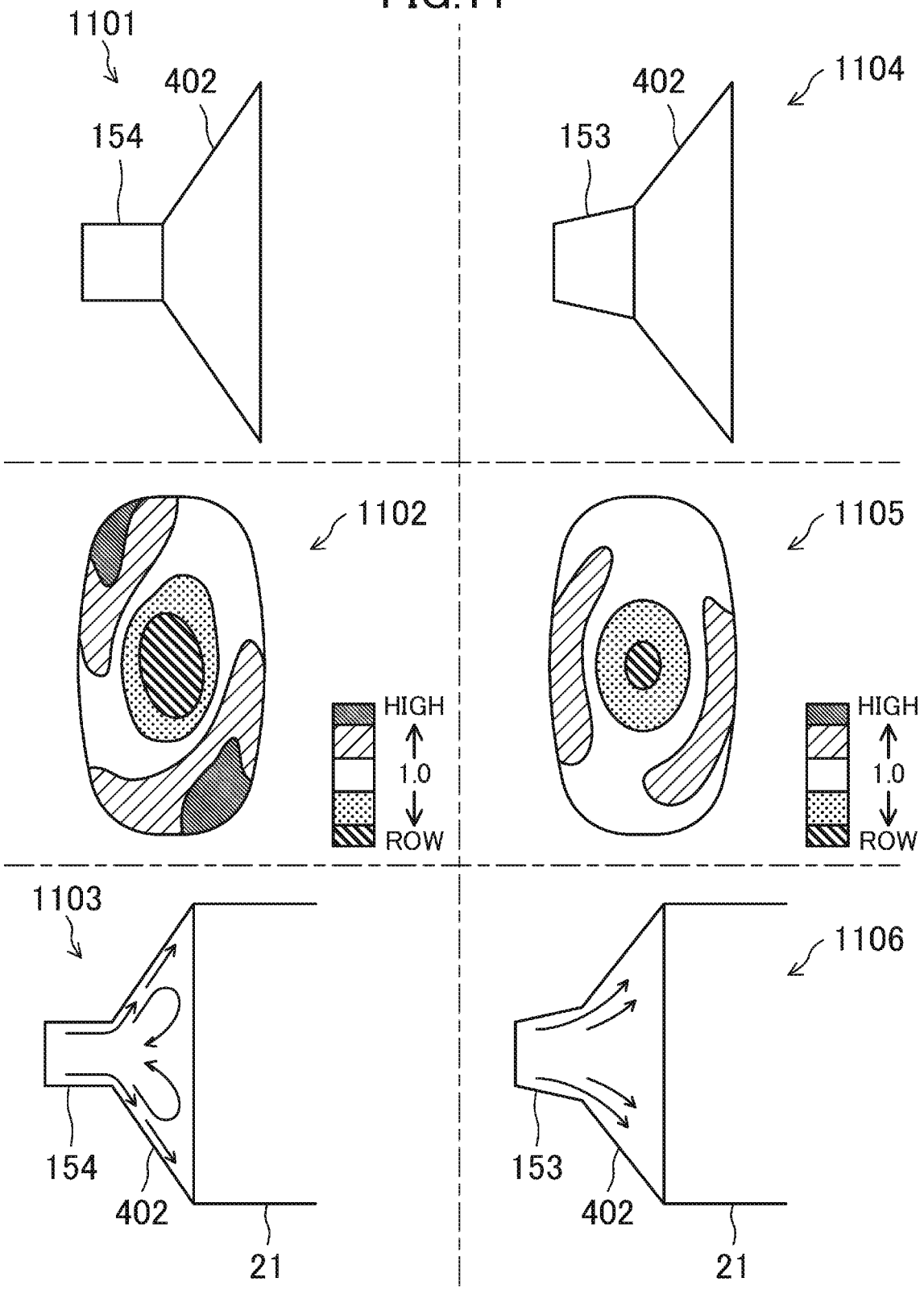
FIG. 11 illustrates the comparison in the exhaust gas flow inside an inlet cone between a straight nozzle and an expanded nozzle, when the exhaust gas swirls strongly.

FIGS. 10 and 11 illustrate simulation results for confirmation of the influence of the expanded nozzle 153 on the exhaust gas flow. Specifically, the case where the outlet of the turbine 151 is not the expanded nozzle 153 but a straight nozzle 154, is compared to the case where the outlet of the turbine 151 is the expanded nozzle 153. In FIGS. 10 and 11, the left column shows the result of simulation using the straight nozzle 154, and the right column shows the result of simulation using the expanded nozzle 153. FIG. 10 shows the result where the exhaust gas discharged from the turbine 151 swirls weakly (i.e., at a low speed of the turbine 151). FIG. 11 shows the result where the exhaust gas swirls strongly (i.e., at a high speed of the turbine 151).

In FIG. 10, reference numerals 1001 and 1004 indicate the shapes of the inlet cone. In FIG. 10, reference numerals 1002 and 1005 indicate contour lines of velocity distribution in the direction of mainstream of the exhaust gas (i.e., the axial direction of the inlet cone) at the outlet of the conical portion 402. The average velocity is 1.0. In FIG. 10, reference numerals 1003 and 1006 indicate the directions of the exhaust gas on the cross-section passing through the central axis of the inlet cone. Similarly, in FIG. 11, reference numerals 1101 and 1104 indicate the shapes of the inlet cone. In FIG. 11, reference numerals 1102 and 1105 indicate constant velocity lines representing velocity distribution in the direction of mainstream of the exhaust gas (i.e., the axial direction of the inlet cone) at the outlet of the conical portion 402. The average velocity is 1.0. In FIG. 11, reference numerals 1003 and 1006 indicate the directions of the flowing exhaust gas on the cross-section passing through the central axis of the inlet cone.

First, the exhaust gas flow in the inlet cone in weak swirling will be described with reference to FIG. 10. In the weak swirling, the velocity component in the axial direction of the inlet cone increases. The exhaust gas flowed into the conical portion 402 through the straight nozzle 154 is, as indicated by the reference numeral 1003, less diffused in the conical portion 402. The exhaust gas goes straight to flow into the case 21 of the exhaust gas purifier. As indicated by the reference numeral 1002, the velocity of the exhaust gas is relatively high in the central area of the outlet of the conical portion 402 and relatively low in the peripheral area.

By contrast, in the structure with the expanded nozzle 153, the velocity of the exhaust gas decreases as it passes through the expanded nozzle 153. In the expanded nozzle 153, the exhaust gas starts diffusing. Thus, as indicated by the reference numeral 1006, the exhaust gas diffuses easily. As indicated by the reference numeral 1005, at the outlet of the conical portion 402, the velocity distribution of the exhaust gas becomes more uniform than in the case of the straight nozzle 154. A uniform velocity distribution of the exhaust gas flowing into the case 21 improves the exhaust gas purification performance passing through the catalytic converter. In addition, the uniform velocity distribution reduces the resistance of the exhaust gas, which improves the fuel efficiency.

Next, the exhaust gas flow in the inlet cone in strong swirling will be described with reference to FIG. 11. In strong swirling, the exhaust gas flows toward the peripheral area due to the centrifugal force. In the straight nozzle 154, the exhaust gas tends to flow toward the peripheral area of the nozzle. As indicated by the reference numeral 1003, in the portion of the straight nozzle 154 connected to the conical portion 402, the exhaust gas flows along the inner peripheral surface of the conical portion 402. In this manner, as indicated by the reference numeral 1102, the velocity of the exhaust gas is high in the peripheral area at the outlet of the conical portion 402. In strong swirling, while the exhaust gas flows toward the peripheral area due to the centrifugal force, the velocity component in the axial direction of the inlet cone decreases. Thus, at the outlet of the conical portion 402, the velocity of the exhaust gas is low at central portion. The velocity distribution of the exhaust gas flowing into the case 21 becomes ununiform.

By contrast, in the structure with the expanded nozzle 153, the velocity of the exhaust gas decreases as it passes through the expanded nozzle 153. This reduces concentration of the exhaust gas toward the peripheral area of the nozzle. As indicated by the reference numeral 1106, this results in reduction in exhaust gas flowing along the inner peripheral surface of the conical portion 402 at the portion of the expanded nozzle 153 connected to the conical portion 402. The exhaust gas diffuses in the conical portion 402. As indicated by the reference numeral 1105, at the outlet of the conical portion 402, the velocity distribution of the exhaust gas becomes more uniform than in the case of the straight nozzle 154.

In this manner, the expanded nozzle 153 provided upstream of the conical portion 402 makes uniform the velocity distribution of exhaust gas flowing into the case 21 of the exhaust gas purifier 2 both in the cases where exhaust gas swirls weakly and strongly.

The exhaust gas flowing at a recessed conical portion will now be considered. As indicated by the reference numeral 1105 in FIG. 11, When the exhaust gas swirls strongly, the velocity of the exhaust gas increases in the portions corresponding to the long sides of the case 21, which has the flat transverse section including a pair of short sides and a pair of long sides. If the exhaust gas passing through the exhaust gas purifier has a biased velocity distribution, exhaust gas purification performance may deteriorate. Strong swirling of the exhaust gas corresponds to a high turbine speed. An increase in the flow rate of the exhaust gas in the portions corresponding to the long sides may cause an excessive temperature rise at the certain portion, which leads to a heat damage.

Figure 12:
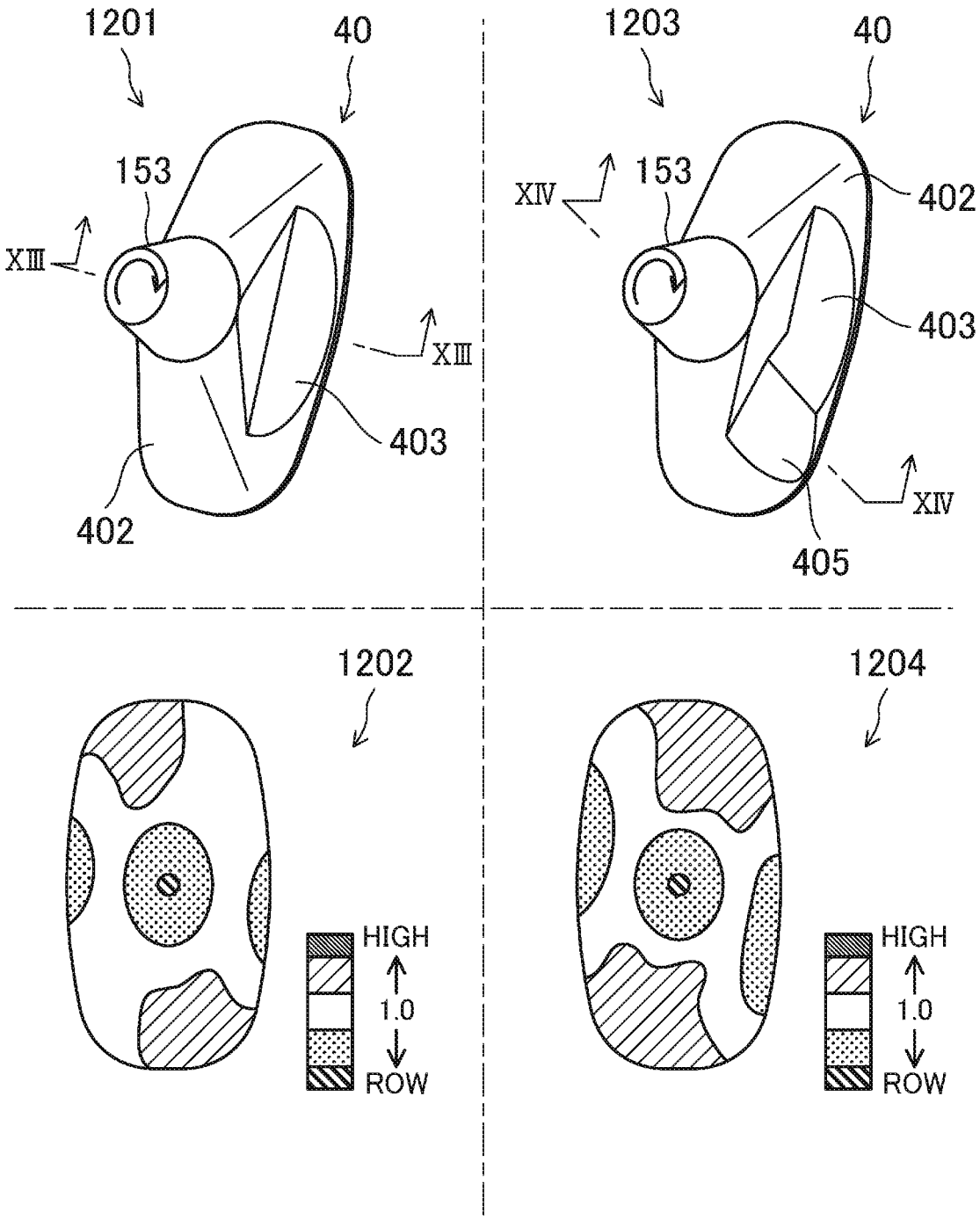
FIG. 12 illustrates the exhaust gas flow inside a recessed inlet cone.

Thus, although the expanded nozzle 153 provided upstream of the conical portion 402 makes the velocity distribution of exhaust gas relatively uniform, an improvement is necessary FIG. 12 illustrates simulation of the exhaust gas flow in the inlet cone, where the conical portion 402 is recessed.

Figure 13:
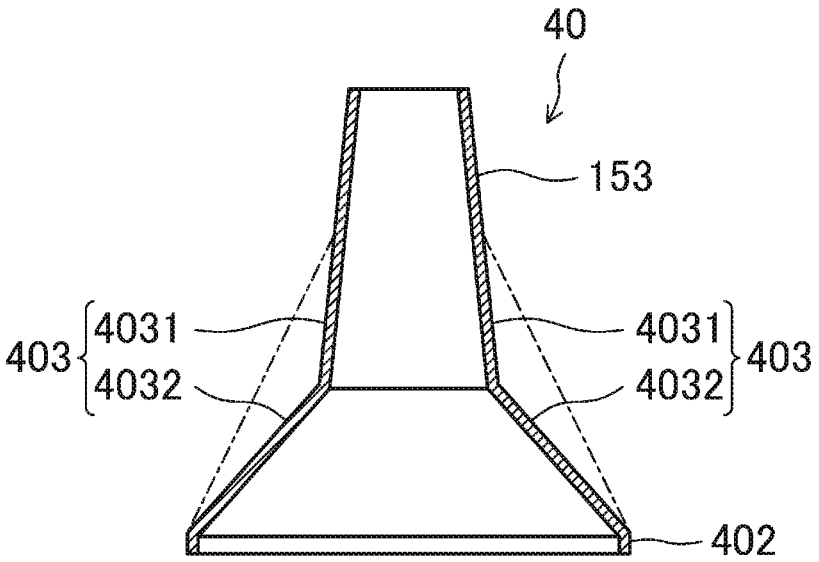
FIG. 13 is a cross-sectional view taken along the line XIII-XIII of FIG. 12.

Reference numeral 1201 of FIG. 12 indicates an inlet cone 40, in which an inward recess 403 is formed in a conical portion 402. As FIG. 13 illustrates cross-section, the recess 403 is provided in each of the right and left inclined walls of the conical portion 402. The recess 403 of the right inclined wall has the same shape as the recess 403 of the left inclined wall. Like the recess described before, each recess 403 spreads along the mainstream of the exhaust gas (i.e., the vertically in FIG. 13), and includes a first wall 4031 and a second wall 4032. The first wall 4031 expands along the long sides. The second wall 4032 is continuous with the first wall 4031, and expands outward from the first wall 4301 along the long sides.

As described above, strong swirling of the exhaust gas causes centrifugal force, which orients the exhaust gas toward the peripheral area. The first wall 4031 of the recess 403 interferes in the exhaust gas flowing from the expanded nozzle 153 into the conical portion 402 and flowing toward the peripheral area of the long side portions to orient the exhaust gas in the direction from the long sides to the short sides along the first wall 4031. This restricts the exhaust gas flowing from the inlet of the conical portion 402 to the portions corresponding to the long sides. As clear from the comparison between the reference numeral 1105 of FIG. 11 and 1202 of FIG. 12, the recess 403 reduces the velocity at the long side portions, and instead, increases the velocity at the short side portions. Since the short side portions are farther from the inlet of the conical portion 402, the flow rate of the exhaust gas tends to decrease. However, if the conical portion 402 has the recess 403, the flow rate of the exhaust gas flowing through the short side portions increases.

In this manner, the recess 403 of the conical portion 402 enables a more uniform velocity distribution of the exhaust gas passing through the case 21 of the exhaust gas purifier 2, which has the flat cross-section. As a result, purification performance of the exhaust gas improves, and heat damages in the portions corresponding to the long sides decreases.

Figure 14:
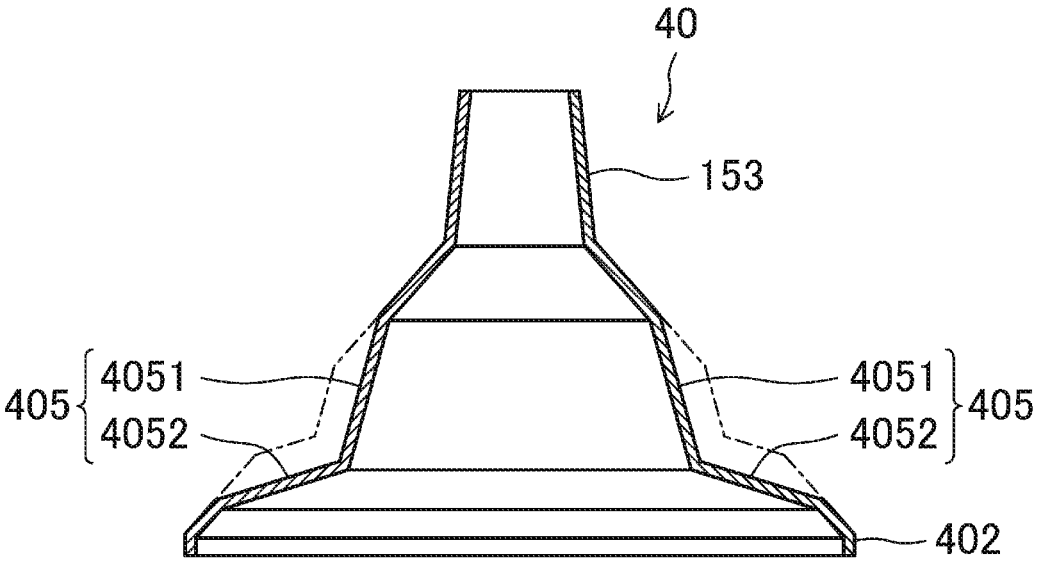
FIG. 14 is a cross-sectional view taken along the line XIV-XIV of FIG. 12.

The reference numeral 1203 in FIG. 12 indicates an inlet cone 40 configured to further accelerate the exhaust gas flowing from the long sides to the short sides. This inlet cone 40 includes a downstream recess 405 adjacent to the recess 403 along the long sides. The downstream recess 405 is located downstream of the recess 403 in the direction in which the exhaust gas swirls. The downstream recess 405 includes a first wall 4051 and a second wall 4052. The first wall 4051 expands along the mainstream of the exhaust gas and along the long sides. The second wall 4052 is continuous with the first wall 4051, and expands outward from the first wall 4501 along the long sides. The downstream recess 405 is recessed deeper than the recess 403, which is illustrated virtually in FIG. 14. Since the downstream recess 405 is provided downstream of the recess 403 in the swirling direction, the exhaust gas flowing from the long sides to the short sides is further accelerated. As clear from the comparison between the reference numeral 1202 and 1204 of FIG. 12, the portions (the hatched portions in FIG. 12), in which the velocity of the exhaust gas is relatively high, of the portions corresponding to the short sides are moved by the downstream recess 405 to downstream positions in the direction in which the exhaust gas swirls (clockwise in this embodiment). In this manner, the combination of the (upstream) recess 403 and the downstream recess 405 controls the positions of the areas with a high exhaust gas velocity in the exhaust gas purifier 2 with the flat cross-section. The exhaust gas is diffused in the conical portion 402 to make the velocity distribution of the exhaust gas flowing into the case 21 uniform. As a result, the exhaust gas purifier 2 maintains high purification performance of the exhaust gas, and is subjected to less heat damages in certain portions.

Figure 15:
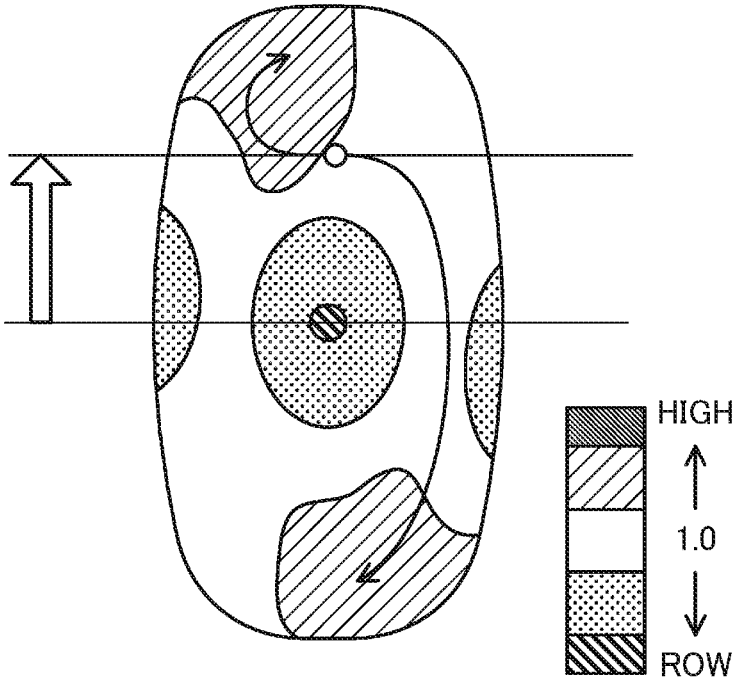
FIG. 15 illustrates the exhaust gas flow when the position of an exhaust pipe connected to an inlet cone is shifted.

Like the embodiment described above, FIG. 15 is used to study the influence of the shift of the inlet of the conical portion 402 from the center to one of facing short sides. The constant velocity lines of FIG. 15 are the same as the reference numeral 1202 of FIG. 12. Assume that the inlet of the conical portion 402 is, as indicated by a white circle in FIG. 15, shifted upward from center of the conical portion 402 to one of the sides, that is, as indicated by the white arrow in FIG. 15. Then, the distance between the inlet of the conical portion 402 and the upper short side is relatively short, and the distance between the inlet of the conical portion 402 and the lower short side is relatively long.

The recess 403 provided in the conical portion 402 restricts the exhaust gas flowing from the inlet of the conical portion 402 toward the peripheral area of the long sides, when the exhaust gas swirls strongly, and orients the exhaust gas in the direction from the long sides to the short sides. The larger the recess 403 is, the more the exhaust gas flowing from the long sides to the short sides is accelerated.

In view of the direction in which the exhaust gas swirls (i.e., clockwise in FIG. 15), the recess in the right inclined wall is, in one preferred embodiment, larger to orient the exhaust gas from the long sides to the short sides and accelerate the flow. On the other hand, the recess in the left inclined wall is smaller in the preferred embodiment.

In short, the first recess is formed in the left long side, through which the exhaust gas passes from the inlet of the conical portion 402 to the upper short side in the direction in which the exhaust gas swirls. The second recess is formed in the right long side, through which the exhaust gas passes from the inlet of the conical portion 402 to the lower long side in the direction in which the exhaust gas swirls. The second recess is larger than the first recess in this preferred embodiment.

This configuration is applicable to the structure of the inlet cone 4 of the exhaust gas purifier 2 shown in FIGS. 3 to 8. However, the positions of the first and second recesses are inverted, since the exhaust gas swirls in the opposite directions in the embodiment described above and the structure of FIG. 15.

That is, if the inlet of the inlet cone 4 is shifted vertically, a difference in size between the right and left recesses with the inlet interposed therebetween makes the velocity distribution of the exhaust gas flowing into the case 21 of the exhaust gas purifier 2, which has the flat transverse section.

What is claimed is:

1. An engine exhaust structure comprising:

a turbine of a turbocharger provided for an exhaust pipe of an engine, and rotated by energy of exhaust gas of the engine; and an exhaust gas purifier connected directly downstream of the turbine, and configured to purify the exhaust gas, wherein the exhaust gas purifier includes a case having a flat transverse section including a pair of facing short sides and a pair of facing long sides, and configured to house a catalytic converter, and an inlet cone including a conical portion, and configured to connect an outlet of the turbine to an inlet of the case, the conical portion including an inclined wall inclined from a mainstream of the exhaust gas to increase a transverse section of a path of the exhaust gas, and wherein a recess recessed inward is formed in a portion corresponding to each of the facing long sides of the inclined wall of the conical portion.

2. The engine exhaust structure of claim 1, wherein the recess includes a first wall expanding along the mainstream of the exhaust gas and along the facing long sides, and a second wall continuous with the first wall, and expanding outward from the first wall along the facing long sides.

3. The engine exhaust structure of claim 1, wherein an expanded portion is provided between the outlet of the turbine and an inlet of the inlet cone, and a transverse section of a path of the exhaust gas gradually increases in the expanded portion.

4. The engine exhaust structure of claim 1, wherein a position of the outlet of the turbine connected to the conical portion is shifted toward one of the facing short sides in a direction in which the facing short sides face each other, an inlet of the conical portion is interposed between the facing long sides, a first recess is formed in a portion of one of the facing long sides, through which the exhaust gas from the inlet of the conical portion passes in a direction, in which the exhaust gas swirls, to reach the one of the facing short sides, and a second recess is formed in a portion of the other one of the facing long sides, through which the exhaust gas from the inlet of the conical portion passes in the direction, in which the exhaust gas swirls, to reach the other one of the facing short sides, wherein the second recess is larger than the first recess.

5. The engine exhaust structure of claim 1, wherein the recess includes an upstream recess located upstream in a direction in which the exhaust gas swirls along the facing long sides, and a downstream recess located downstream in the direction in which the exhaust gas swirls along the facing long sides, wherein the downstream recess is recessed more deeply than the upstream recess.

6. The engine exhaust structure of claim 1, wherein an engine compartment including the engine includes the exhaust gas purifier and a second exhaust gas purifier connected downstream of the exhaust gas purifier.

7. The engine exhaust structure of claim 1, wherein the engine is mounted longitudinally, the case of the exhaust gas purifier has a vertically long flat transverse section, the exhaust gas purifier is placed on a side of the engine, and the engine and the exhaust gas purifier are surrounded and encapsulated by a partition.

8. The engine exhaust structure of claim 7, wherein the turbine is placed above an exhaust manifold of the engine, the exhaust gas purifier is placed near a top of the engine, and a heat shielding wall covering the engine and the exhaust gas purifier is placed above the exhaust gas purifier.

* * * * *